US008934796B2

(12) United States Patent
Ikeda

(10) Patent No.: US 8,934,796 B2
(45) Date of Patent: Jan. 13, 2015

(54) IMAGE FORMING APPARATUS WITH SELECTIVE UTILIZATION OF AC VOLTAGE SOURCE

(71) Applicant: Canon Kabushiki Kaisha, Tokyo (JP)

(72) Inventor: Yuichi Ikeda, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/755,152

(22) Filed: Jan. 31, 2013

(65) Prior Publication Data

US 2013/0209117 A1 Aug. 15, 2013

(30) Foreign Application Priority Data

Feb. 15, 2012 (JP) ..... 2012-030558

(51) Int. Cl.
*G03G 15/02* (2006.01)
*G03G 15/05* (2006.01)
*G03G 15/01* (2006.01)

(52) U.S. Cl.
CPC ..... *G03G 15/05* (2013.01); *G03G 15/0136* (2013.01); *G03G 15/0266* (2013.01)
USPC ..... 399/50; 399/168

(58) Field of Classification Search
USPC ..... 399/50, 55, 115, 168, 174, 176
See application file for complete search history.

(56) References Cited

U.S. PATENT DOCUMENTS

| | | | | |
|---|---|---|---|---|
| 6,324,374 | B1 * | 11/2001 | Sasamoto et al. | 399/298 |
| 6,408,145 | B1 * | 6/2002 | Ohki | 399/50 |
| 6,553,192 | B2 * | 4/2003 | Maebashi | 399/50 |
| 7,058,326 | B2 * | 6/2006 | Toyama | 399/50 |
| 2004/0141766 | A1 * | 7/2004 | Toyama | 399/50 |
| 2007/0264034 | A1 * | 11/2007 | Kamoshida | 399/26 |
| 2008/0050143 | A1 * | 2/2008 | Barry | 399/89 |
| 2008/0170867 | A1 * | 7/2008 | Ahn et al. | 399/13 |
| 2009/0103940 | A1 * | 4/2009 | Tomiie et al. | 399/89 |
| 2012/0195616 | A1 * | 8/2012 | Miyahara | 399/55 |

FOREIGN PATENT DOCUMENTS

JP 2004-151612 A 5/2004

* cited by examiner

*Primary Examiner* — G. M. Hyder
(74) *Attorney, Agent, or Firm* — Fitzpatrick, Cella, Harper & Scinto

(57) ABSTRACT

An image-forming apparatus includes a first image-forming portion; a second image-forming portion; an executing portion for executing an operation in a first mode in which an image is formed on a recording material by the first and second image-forming portions or a second mode in which an image is formed by the second image-forming portion; an AC-voltage source; a first DC-voltage source; a second DC-voltage source; and a controller for controlling the first and second DC-voltage sources and the AC-voltage source. In the first mode, application of the AC voltage by the AC-voltage source and the DC voltages by the first and second DC-voltage sources are performed, and in the second mode, application of the DC voltage by the second DC-voltage source is performed, and application of the AC voltage by the AC-voltage source and the DC voltage by the first DC-voltage source are stopped.

3 Claims, 6 Drawing Sheets

IMAGE FORMING APPARATUS WITH SELECTIVE UTILIZATION OF AC VOLTAGE SOURCE

FIELD OF THE INVENTION AND RELATED ART

The present invention relates to an image forming apparatus such as a copying machine, a printer, a facsimile machine or a multi-function machine having a plurality of functions of these machines.

In recent years, as an electrophotographic image forming apparatus for a plurality of colors or a full color, a tandem type image forming apparatus has been proposed. In the tandem type image forming apparatus, a plurality of photosensitive drums as a photosensitive member are juxtaposed and color toner images formed on the photosensitive drums, respectively, are successively superposed to form a color image. It has been known that the tandem type image forming apparatus is operable in a first mode for effecting full-color image formation and a second mode for effecting monochromatic image formation.

Such a tandem type image forming apparatus has been disclosed in Japanese Laid-Open Patent Application (JP-A) 2204-151612. In JP-A 2004-151612, the tandem type image forming apparatus, in which an AC voltage and a common DC voltage are supplied from a single AC voltage source and a single DC voltage source to a plurality of charging rollers and during an operation in a monochromatic mode which is the second mode for effecting monochromatic image formation, application of the AC voltage is stopped and only the DC voltage is applied, is disclosed.

In the case of a structure described in JP-A 2004-151612, the DC voltage is applied to also charging rollers provided at other image forming portions where the image is not formed during the operation in the monochromatic mode, so that electric power is wastefully consumed.

SUMMARY OF THE INVENTION

The present invention has been accomplished in view of the above-described circumstances. A principal object of the present invention is to provide an image forming apparatus capable of realizing cost reduction and a reduction in electric power consumption in the case where an operation in a second mode is executed.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
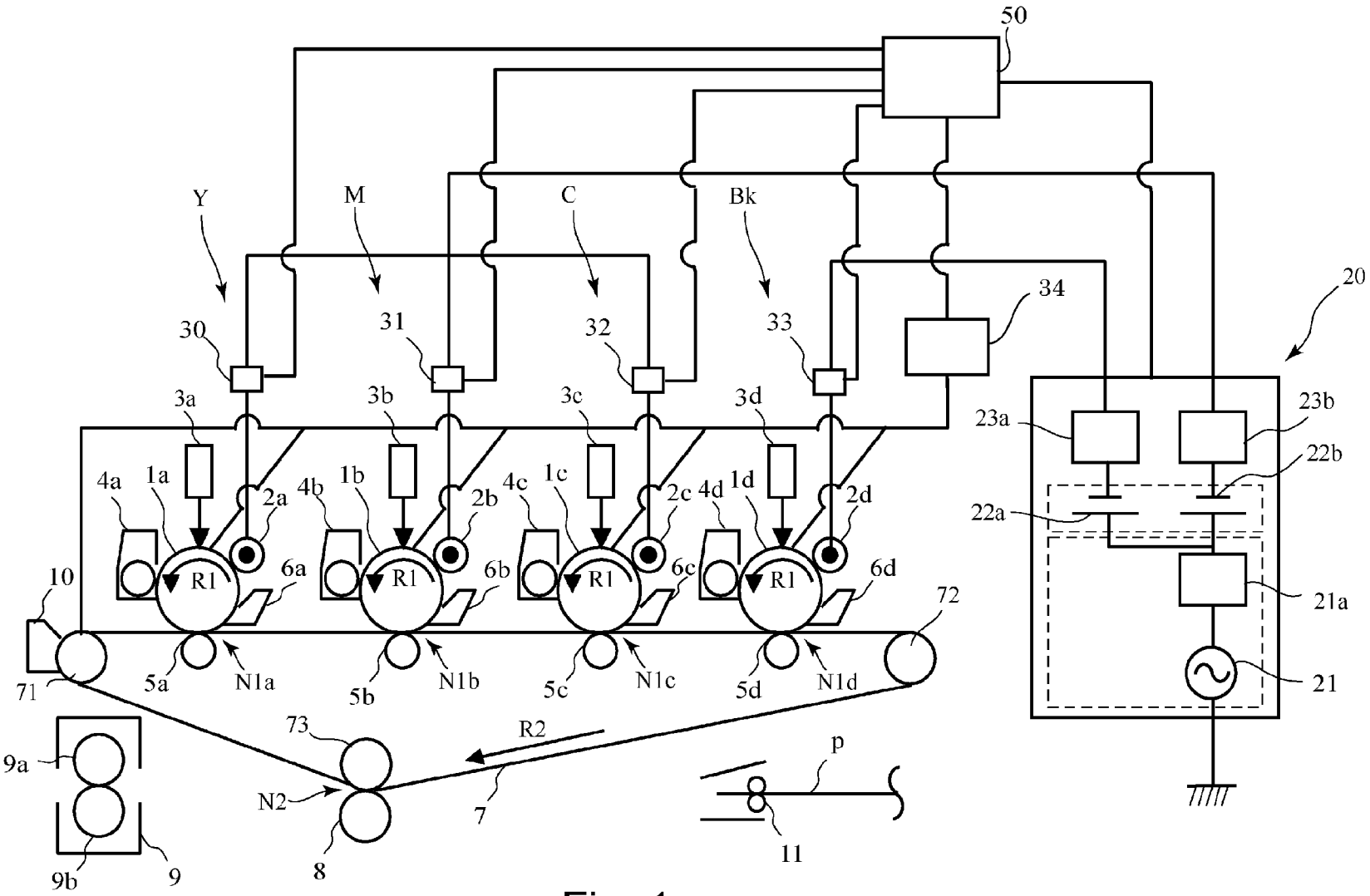
FIG. 1 is a schematic structural view of an image forming apparatus according to First Embodiment of the present invention.

Embodiments of the present invention will be described with reference to the drawings.

<First Embodiment>

First Embodiment of the present invention will be described with reference to FIGS. 1 to 4. First, a schematic structure of an image forming apparatus in this embodiment will be described with reference to FIG. 1. Incidentally, in the respective drawings, members or portions which are represented by the same reference numerals or symbols have the same constitutions or functions and will be appropriately omitted from redundant description.

[Image Forming Apparatus]

The image forming apparatus in this embodiment has a structure of a tandem type in which a plurality of image forming portions are juxtaposed. That is, the image forming apparatus includes an image forming portion Y for forming an image of yellow, an image forming portion M for forming an image of magenta, an image forming portion C for forming an image of cyan, and an image forming portion Bk for forming an image of black. These four image forming portions are disposed in parallel at certain intervals along a movement direction of an intermediary transfer belt 7.

Incidentally, structures of the respective image forming portions are substantially the same except that colors of toners are different from each other, and therefore similar constituent elements will be described by omitting suffixes showing associated constituent elements of the respective image forming portions. Here, the suffixes "a", "b", "c" and "d" represent that constituent elements having the suffixes are those at the image forming portions Y, M, C and Bk, respectively.

At each of the image forming portions, a photosensitive drum 1 as a photosensitive member is provided. At a periphery of the photosensitive drum 1, a charging roller 2 as a charger, an exposure device 3, a developing device 4, and a drum cleaning device 6 are successively provided along a rotational direction (R1 direction) of the photosensitive drum 1. In the developing devices 4*a*, 4*b*, 4*c* and 4*d*, a yellow toner, a magenta toner, a cyan toner and a black toner are accommodated, respectively.

Further, adjacently to the photosensitive drums 1*a* to 1*d* of the respective image forming portions, a belt member which is capable of being circulated and moved as an intermediary transfer member, i.e., the intermediary transfer belt 7 is provided. The intermediary transfer belt 7 is extended around a driving roller 71, a tension roller 72 and a secondary transfer inner roller 73. The intermediary transfer belt 7 is circulated and moved in a direction indicated by an arrow R2 by transmission of a driving force thereto from the driving roller 71 as a belt driving means. Drive control of the driving roller 71 is effected by a control circuit 50 as a controller via a motor control circuit 34.

Further, in an inner peripheral surface side of the intermediary transfer belt 7, at positions opposite from the photosensitive drums 1*a*-1*d*, primary transfer rollers 5*a*-5*d* as a transfer member are provided. The intermediary transfer belt 7 is urged by the primary transfer rollers 5*a*-5*d* toward the photosensitive drums 1*a*-1*d*, respectively, to form primary transfer portions (primary transfer nips) N1*a*-N1*d* where the photosensitive drums 1*a*-1*d* contact the intermediary transfer belt 7. That is, the primary transfer rollers 5*a*-5*d* are disposed so as to sandwich the intermediary transfer belt 7 between themselves and the photosensitive drums 1*a*-1*d*, respectively.

Further, in an outer peripheral surface side of the intermediary transfer belt 7, at a position opposite from the secondary transfer inner roller 73, a secondary transfer outer roller 8 as a secondary transfer member is provided. The secondary transfer outer roller 8 contacts the outer peripheral surface of the intermediary transfer belt 7 to form a secondary transfer portion (secondary transfer nip) N2.

At each of the image forming portions, the surface of the photosensitive drum 1 is electrically charged by the charging roller 2 to a predetermined potential. Then, on the charged surface of the photosensitive drum 1, an electrostatic latent image is formed by the exposure device 3 such as a laser, and the electrostatic latent image is developed with an associated color toner. As a result, on the surfaces of the photosensitive drums 1*a*-1*d*, the color toner images are formed, respectively. In this embodiment, the exposure device 3 and the developing device 4 constitute a toner image forming means.

The images formed on the photosensitive drums 1*a*-1*d* at the image forming portions are successively transferred superposedly onto the intermediary transfer belt 7, which moves and passes adjacently to the photosensitive drums 1*a*-1*d*, by applying a transfer bias to the primary transfer rollers 5*a*-5*d*. Thereafter, the images transferred on the intermediary transfer belt 7 are further transferred onto the recording material P such as paper at the secondary transfer portion N2 by applying a second transfer bias to the secondary transfer outer roller 8.

The recording material P is supplied to the secondary transfer portion N2 by a sheet feeding roller 11. Thereafter, on the recording material P separated from the secondary transfer outer roller 8, a full-color toner image is fixed at a fixing nip between a fixing roller 9*a* and a pressing roller 9*b* of a fixing apparatus (device) 9. Then, the recording material P after the image fixing is discharged to the outside of the image forming apparatus. The toner which is not completely transferred at the secondary transfer portion N2 is removed by a transfer cleaner 10.

Figure 2:
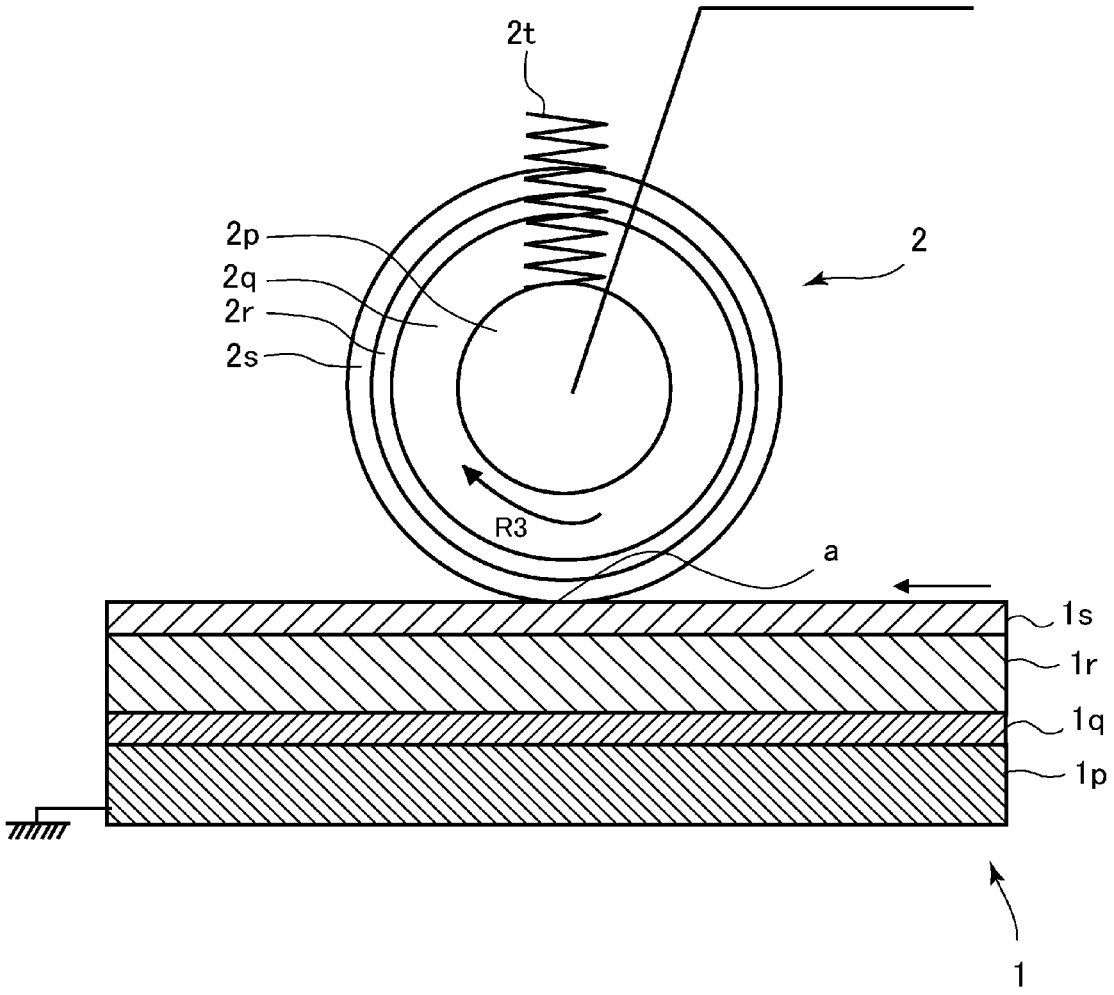
FIG. 2 is a schematic view showing a layer structure of each of a charging roller and a photosensitive drum.

In this embodiment, the photosensitive drum 1 is, e.g., a negatively chargeable organic photosensitive member (OPC) of 30 mm in outer diameter and is rotationally driven at a normal process speed (peripheral speed) of 210 mm/sec in an arrow R1 direction (counterclockwise direction) by drive of a driving device (not shown). Drive control of the photosensitive drum 1 is effected by the control circuit 50 as the controller via the motor control circuit 34. Such a photosensitive drum 1 is, as shown in FIG. 2, constituted by applying, onto a surface of an aluminum cylinder (electroconductive drum substrate) 1*p*, successively three layers, from below, an undercoat layer 1*g* for suppressing light interference and for improving adhesive property with an upper layer, a photocharge generating layer 1*r* and a photocharge transporting layer 1*s*. A thickness of the photocharge transporting layer is, e.g., 28 μm and when this layer is abraded to 13 μm, a problem such as improper charging occurs.

Further, the charging roller 2 is, e.g., 320 mm in longitudinal length and has, as shown in FIG. 2, a three-layer structure in which on a core metal (supporting member) 2*p*, three layers consisting of a lower layer 2*q*, an intermediary layer 2*r* and a surface layer 2*s* are successively laminated from below. The lower layer 2*q* is a foam sponge layer for reducing charging noise, and the surface layer 2*s* is a protective layer provided for preventing an occurrence of leakage even when there is a pin hole or the like on the photosensitive drum 1.

More specifically, the specification of the charging roller 2 in this embodiment is, e.g., as follows. The core metal 2*p* is a stainless steel round bar of 6 mm in diameter. The lower layer 2*q* is formed of foam EPDM in which carbon black is dispersed, and is 0.5 g/cm$^3$ in specific gravity, $10^2$-$10^9\Omega$ in volume resistance value and 3.0 mm in thickness. The intermediary layer 2*r* is formed of NBR rubber in which carbon black is dispersed, and is $10^2$-$10^5$ in volume resistance value and 700 μm in thickness. The surface layer is formed of a fluorine-containing compound (resin material) in which tin oxide and carbon black are dispersed, and is $10^7$-$10^{10}\Omega$ in volume resistance value, 1.5 μm in surface roughness (10-point average surface roughness Ra in accordance with JIS) and 10 μm in thickness.

Further, the charging roller 2 is urged toward the center of the photosensitive drum 1 by an urging spring 2*t* and is press-contacted to the surface of the photosensitive drum 1 with a predetermined urging force, thus being rotated by rotational drive of the photosensitive drum 1. A press-contact portion between the photosensitive drum 1 and the charging roller 2 is a charging portion (charging nip) a. In this embodiment, the volume resistance value of the entire charging roller 2 is, e.g., $1.0\times10^5\Omega$.

[Voltage (Power) Source for Charging Roller]

A voltage source 20 generates a charging bias by a combination of an AC voltage source 21, a DC voltage source 22 and a DC voltage amplifier circuit 23. In this embodiment, the AC voltage source 21 is common to the respective image forming portions but the DC voltage source 22 includes two systems consisting of a DC voltage source 22*a* for the charging roller 2*d* and a DC voltage source 22*b* for the charging rollers 2*a*, 2*b* and 2*c*. That is, as shown in FIG. 1, the voltage source 20 includes a single AC voltage source 21, two DC voltage sources 22*a* and 22*b* and two DC voltage amplifier circuits 23*a* and 23*b*. Further, with respect to the DC voltage, the DC voltage for the charging roller 2*d* for Bk and the DC voltage for the charging rollers 2*a*, 2*b* and 2*c* for Y, M and C are capable of being applied independently from each other, and values of the DC voltages are adjusted by the DC voltage amplifier circuits 23*a* and 23*b*. Here, the DC voltage source 22*a* for applying the DC voltage to the charging roller 2*d* as a second charging member corresponds to a second DC voltage source, and the DC voltage source 22*b* for applying the DC voltage to the charging rollers 2*a*-2*c* as a first charging member corresponds to a first DC voltage source.

Further, the AC voltage applied to the charging rollers 2*a*-2*d* is applied in common by the AC voltage source 1. Further, a value of the AC voltage is adjusted by an AC voltage amplifier circuit 21*a* in the AC voltage source 21. Such a voltage source 20 is controlled by the control circuit 50 as the controller. In this embodiment, a frequency of the AC voltage circuit is 1.5 kHz but is appropriately set.

Setting of values of AC currents Iac passing through the charging rollers 2*a*, 2*b*, 2*c* and 2*d* is made in the following manner. First, the current values are measured by AC current measuring devices 30, 31, 32 and 33, respectively, while changing (increasing and decreasing) a peak-to-peak voltage Vpp by the AC voltage amplifier circuit 21*a*. As a result, a relationship between the applied peak-to-peak voltage Vpp and the measured AC current Iac is calculated by the control circuit 50 to obtain an applied AC voltage value or an applied DC voltage value with respect to a necessary predetermined discharge current amount, so that the resultant AC current value is set at a value of AC current to be applied during image formation.

The charging roller 2 perform (DC+AC) charging in which the voltage is applied in the form of the DC voltage biased with the AC voltage or DC charging in which only the DC voltage is applied. In the (DC+AC) charging, e.g., in the case where the photosensitive drum 1 is intended to be charged to a surface potential of −700 V, the DC voltage is set at −700 V and then the charging is performed at the voltage in the form of the DC voltage biased with a high AC voltage of sine wave at a frequency of 1.5 kHz. At this time, there is a need to apply the peak-to-peak voltage Vpp which is not less than Vth×2 (V) where Vth is a discharge start voltage with respect to the photosensitive drum 1 during application of the DC voltage to the charging roller 2, and in this embodiment, the peak-to-peak voltage Vpp was, e.g., 1.5 kV.

As a feature of the (DC+AC) charging, there is an advantage such that the surface potential of the photosensitive drum 1 is converged to the applied DC voltage by the AC voltage to obtain uniform charging and thus image density non-uniformity due to charging non-uniformity is less. On the other hand, in addition to DC discharging, also discharging by the AC voltage is provided to the photosensitive drum 1 and therefore a degree of drum deterioration (abrasion) is increased to several times that in the case of the DC charging, so that an abrasion lifetime of the photosensitive drum 1 is shortened.

In the DC charging, e.g., in the case where the photosensitive drum 1 is charged to the surface potential of −700 V, there is a need to set the DC voltage at −(700+discharge start voltage Vth). In this embodiment, Vth=600 V and therefore the applied voltage is −1300 V.

As a feature of the DC charging, the discharge start voltage Vth varies depending on a shape and contamination of the charging roller 2 and therefore it has been known that potential uniformity in the surface of the photosensitive drum 1 is inferior to that in the case of the (DC+AC) charging and thus image uniformity is inferior to that in the case of the (DC+AC) charging. On the other hand, there is no discharge by the AC component and therefore the deterioration of the photosensitive drum 1 is correspondingly decreased and thus the lifetime against the drum abrasion is extended compared with the case of the (DC+AC) charging.

Figure 3:
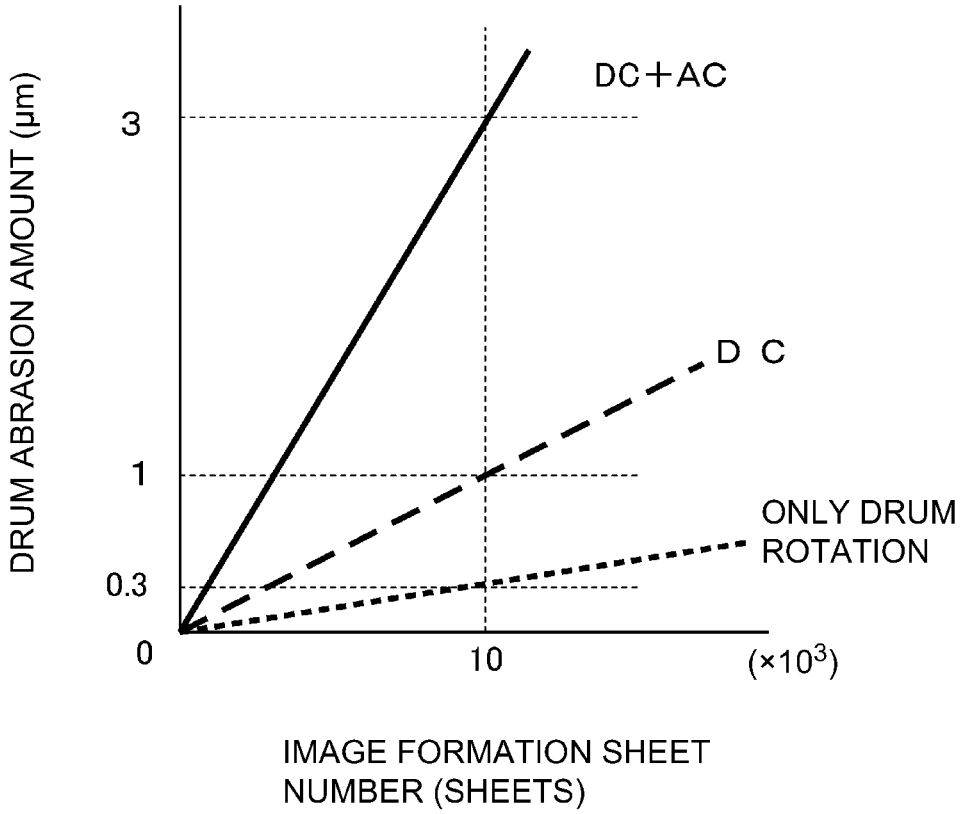
FIG. 3 is a graph showing a relationship between the number of sheets subjected to image formation and an amount of abrasion (wearing) of a drum surface in charging states of the photosensitive drum.

The abrasion amount of the photosensitive drum 1 in each of the charging systems is shown in FIG. 3. In addition to the rotation of the photosensitive drum 1, by applying the charging bias, the degree of the abrasion of the drum surface layer progresses. As is apparent from FIG. 3, in the case of the (DC+AC) charging, the drum surface layer is abraded in the abrasion amount of about 3 μm at the number of sheets subjected to image formation (passed sheet number) of 10,000 sheets. Further, the drum surface layer is abraded in the abrasion amount of about 1 μm per 10,000 sheets in the case of the DC charging and of about 0.3 μm per 10,000 sheets in the case where the photosensitive drum 1 is idled without being charged. That is, the amount of the discharge current is increased in the order of the cases of no charging, the DC charging and the (DC+AC) charging, so that the abrasion amount of the drum surface layer is similarly increased. Therefore, in order to prolong the lifetime of the photosensitive drum 1, there is a need to perform the DC charging rather than the (DC+AC) charging and to perform the idling of the photosensitive drum 1 with no charging rather than the DC charging.

[Image Forming Mode]

In the case of the image forming apparatus in this embodiment, the image forming apparatus is capable of executing an operation in an image forming mode of two types including a full-color mode for forming a full-color image as an image of a plurality of colors and a monochromatic mode for forming an image of only black. That is, in the operation in the monochromatic mode as the second mode, a black toner image is formed on only the photosensitive drum 1*d* for Bk as the second photosensitive member. Further, in the operation in the full-color mode as the first mode, the toner images are formed on not only the photosensitive drum 1*d* but also the photosensitive drums for Y, M and C as the first photosensitive member, respectively.

Further, the control circuit 50 functioning as an executing portion and the controller applies only the DC voltage to the charging roller 2*d* for Bk by the DC voltage source 22*a* but does not apply the AC voltage by the AC voltage source 21 and the DC voltage by the DC voltage source 22*b* in the case where the operation in the monochromatic mode as the second mode is executed. That is, in the operation in the monochromatic mode, only the DC charging is performed with respect to the charging roller 2*d* for Bk. In this embodiment, the DC voltage source 22*b* is connected to the charging rollers 2*a*, 2*b* and 2*c* for Y, M and C, and the DC voltage source 22*a* is connected to all the charging rollers 2*a*-2*d*. Here, the charging roller 2*d* for Bk corresponds to the second charging member, and the charging rollers 2*a*, 2*b* and 2*c* for Y, M and C corresponding to the first charging member, but the AC voltage source 21 is common to these first and second charging members. Therefore, unless the DC voltage is outputted from the DC voltage source 22*b*, the DC voltage is not applied to the charging rollers 2*a*, 2*b* and 2*c* for Y, M and C, and unless the AC voltage is outputted from the AC voltage source 21, the AC voltage is not applied to the charging rollers 2*a*-2*d* of all the image forming portions.

Further, the control circuit 50 applies the voltage in the form of the DC voltage biased with the AC voltage by the DC voltage sources 22*a* and 22*b* and the AC voltage source 21 in the case where the operation in the full-color mode as the first mode is executed. That is, in the operation in the full-color mode, the charging bias of DC+AC is applied to the respective charging rollers 2*a*-2*d*. As described above, the DC voltage source 22*a* is connected to the charging roller 2*d* for Bk, the DC voltage source 22*b* is connected to the charging rollers 2*a*, 2*b* and 2*c* for Y, M and C, and the AC voltage source 21 is connected to all the charging rollers 2*a*-2*d*, and therefore a predetermined charging bias in the form of the DC voltage biased with the AC voltage is applied to each of the charging rollers 2*a*-2*d* of all the image forming portions.

In general, the full-color image includes a halftone portion in many cases and thus image (charging) uniformity is required, but the monochromatic image includes a character or line image in many cases and therefore the image (charging) uniformity is not required compared with the case of the full-color image. For this reason, in this embodiment, in the operation in the monochromatic mode for forming the monochromatic image, only the DC charging in which the charging uniformity is not high is performed, and in the operation in the full-color mode for forming the full-color image, the (DC+AC) charging in which the charging uniformity is high is performed.

Figure 4:
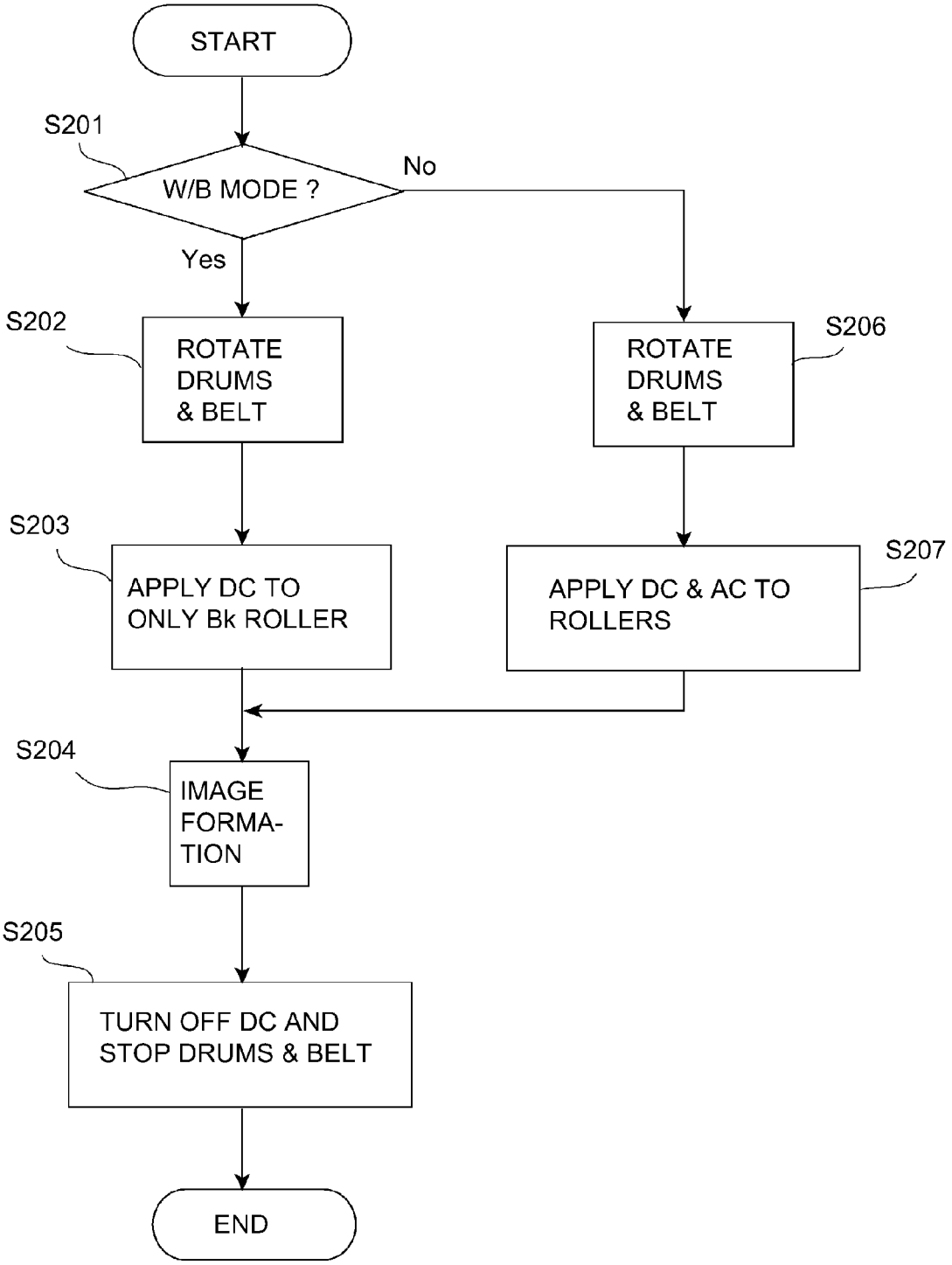
FIG. 4 is a flow chart showing a flow of control in First Embodiment.

A flow of such control in this embodiment will be described with reference to FIG. 4. When printing is started, the control circuit 50 switches control depending on a mode (monochromatic mode or full-color mode) selected by a user (S201). In the case where the mode is switched to the monochromatic mode in S201, the control circuit 50 controls a motor through the motor control circuit 34 to rotate all the photosensitive drums 1*a*-1*d* and the intermediary transfer belt 7 at predetermined speeds, respectively (S202). Here, in the operation in the monochromatic mode, only the photosensitive drum 1*d* for Bk may only be required to be rotated but in this embodiment, also other photosensitive drums 1*a*-1*c* (second photosensitive member) are rotated. This is because when the intermediary transfer belt 7 is rotationally driven while stopping other photosensitive drums 1*a*-1*c*, the surfaces of other photosensitive drums 1*a*-1*c* are damaged.

Then, the control circuit 50 controls the voltage source 20 to apply only a high DC voltage of, e.g., −1300 V to the charging roller 2*d* for Bk by the DC voltage source 22*a*, thus charging the surface of the photosensitive drum 1*d* to a predetermined potential (e.g., −700 V) (S203). At this time, to the charging rollers 2*a*-2*c* for Y, M and C, the AC voltage and the DC voltage are not applied. Then, image formation of a monochromatic (white/black) image is effected (S204). That is, at the image forming portion Bk, a black toner image is formed on the photosensitive drum 1*d* by the exposure device 3*d* and the developing device 4*d*. This black toner image is primary-transferred onto the intermediary transfer belt 7 by the primary transfer roller 5*d* and then is secondary-transferred from the intermediary transfer belt 7 onto the recording material P, and thereafter is fixed as an image on the recording material P by the fixing apparatus 9. When the image formation is ended, the control circuit 50 turns off the application of the high DC by the DC voltage source 22*a* of the voltage source 20 and causes the motor control circuit 34 to stop the rotations of the photosensitive drums 1*a*-1*d* of the intermediary transfer belt 7 (S205), thus ending the operation.

On the other hand, in the case where the mode is switched to the full-color mode in S201, the control circuit 50 controls the motor through the motor control circuit 34 to rotate all the photosensitive drums 1*a*-1*d* and the intermediary transfer belt 7 at the predetermined speeds (S206). Then, the control circuit 50 applies, to the charging rollers 2*a*-2*d* through the voltage source 20, the voltage in the form of a high DC voltage (e.g., −700 V) biased with a high AC voltage (e.g., 1.5 kV as the peak-to-peak voltage Vpp), thus charging each of the surfaces of the photosensitive drums 1*a*-1*d* to, e.g., −700 V (S207). That is, by the DC voltage sources 22*a* and 22*b* and the AC voltage source 21, the voltage in the form of the DC voltage biased with the AC voltage is applied to the charging rollers 2*a*-2*d*. Thereafter, full-color image formation is effected (S204). That is, at all the image forming portions, the respective color toner images are formed and a full-color toner image is transferred onto the recording material P via the intermediary transfer belt 7, and then this full-color toner image is fixed as an image on the recording material P by the fixing apparatus 9. When the image formation is ended, the control circuit 50 turns off the application of the high AC voltage and the high DC voltage by the voltage source 20 and causes the motor control circuit 34 to stop the rotations of the photosensitive drums 1*a*-1*d* and the intermediary transfer belt 7 (S105), thus ending the operation.

In this embodiment, in the operation in the monochromatic mode, the high DC voltage for charging is applied to only the charging roller 2*d* and is not applied to the charging rollers 2*a*-2*c*, and therefore electric power consumption can be more reduced. Further, in this embodiment, the AC voltage source 21 is unified into a single system, so that cost reduction and downsizing of a substrate can be realized.

<Second Embodiment>

Figure 5:
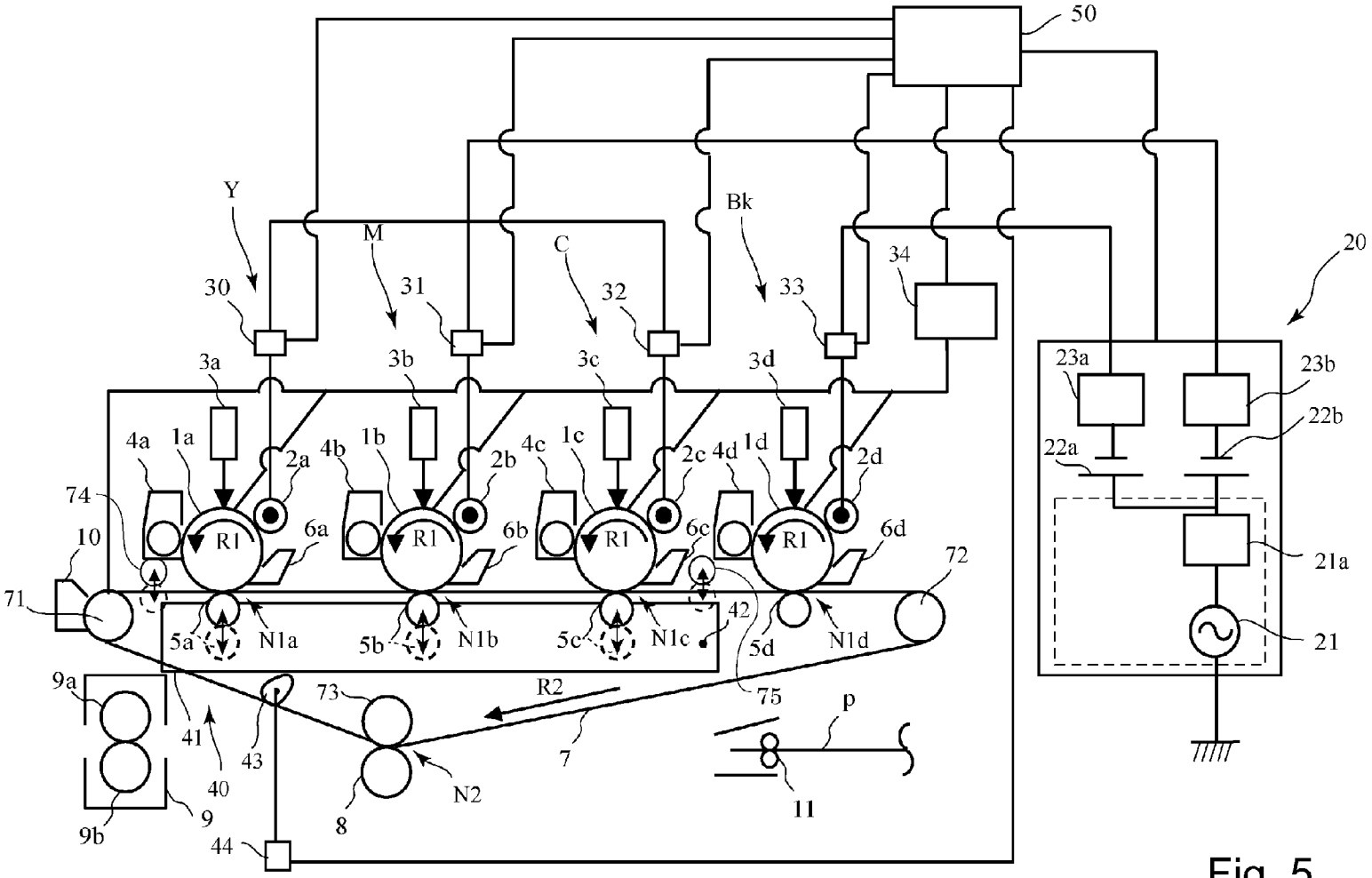
FIG. 5 is a schematic structural view of an image forming apparatus according to Second Embodiment.
Figure 6:
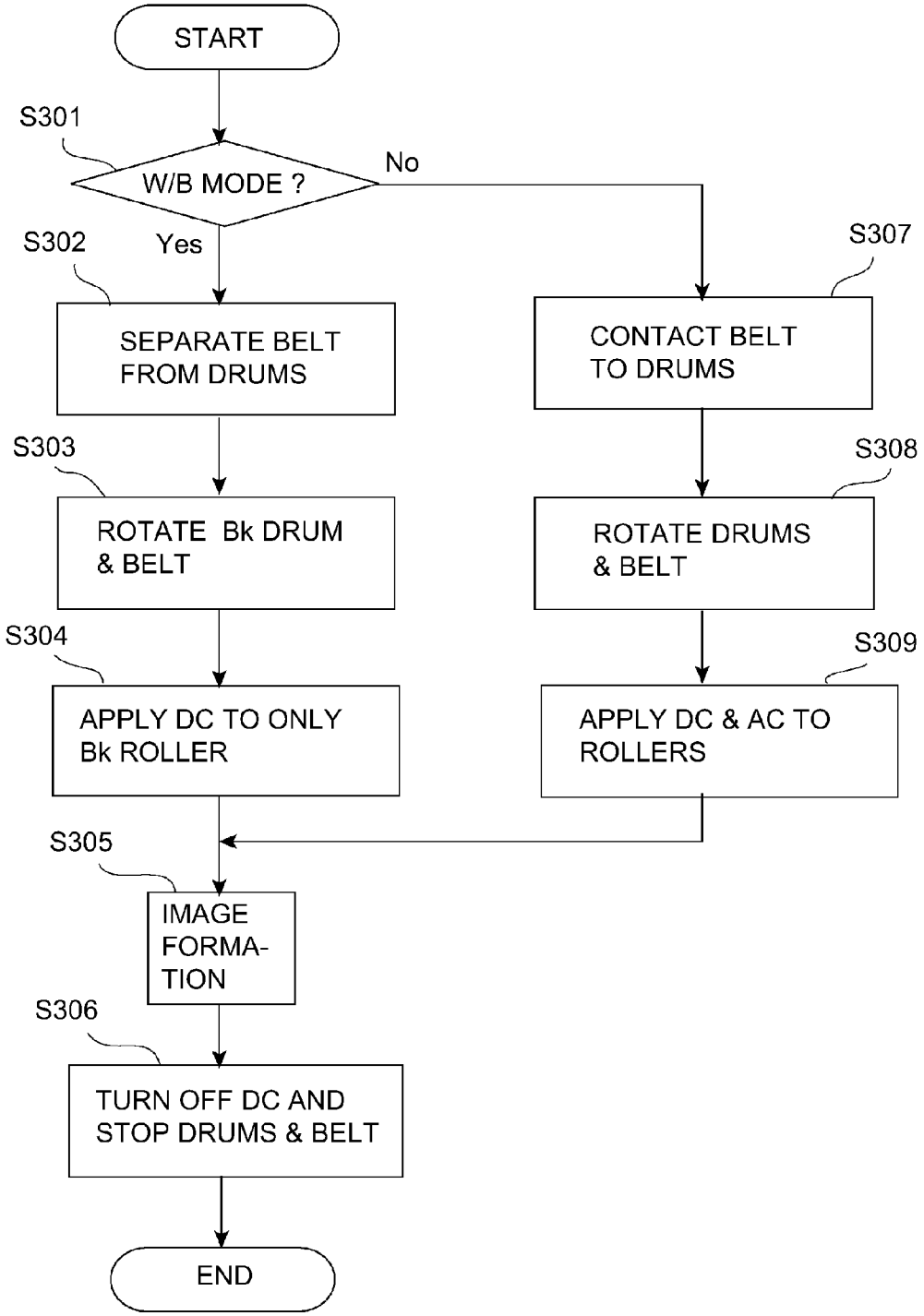
FIG. 6 is a flow chart showing a flow of control in Second Embodiment.

Second Embodiment of the present invention will be described with reference to FIGS. 5 and 6. In the above-described First Embodiment, also the monochromatic mode, other photosensitive drums 1*a*-1*c* are rotated but the drum surface layer is abraded by only the rotation of the photosensitive drum 1 by the influence of the drum cleaning device 6 or the like, so that the lifetime of the photosensitive drum is shortened. Therefore, in the operation in the monochromatic mode in which the toner image is not formed on other photosensitive drums 1*a*-1*c*, other photosensitive drums 1*a*-1*c* are intended not to be rotated to the possible extent.

Therefore, in this embodiment, similarly as in First Embodiment, the high AC voltage is common to the four colors and the high DC voltage is applied from the two high voltage systems for black and other colors. Further, in the operation in the monochromatic mode intermediary transfer belt 7 opposing other photosensitive drums 1*a*-1*c* is spaced from other photosensitive drums 1*a*-1*c*, and other photosensitive drums 1*a*-1*c* are stopped.

Description will be made specifically with reference to FIG. 5. In this embodiment, a contact-and-separation device 40 as a spacing mechanism for moving the primary transfer rollers 5*a*-5*c* as the first transfer member disposed opposed to the photosensitive drums 1*a*-1*c* as the first photosensitive member via the intermediary transfer belt 7 and for moving spacing rollers 74 and 75 in interrelation with the movement of the primary transfer rollers 5*a*-5*c*. The contact-and-separation device 40 is capable of setting two states consisting of a contact state (solid line in the figure) in which the intermediary transfer belt 7 is contacted to the photosensitive drum by contact of the primary transfer rollers 5*a*-5*c* with the intermediary transfer belt 7 and by spacing of the spacing rollers 74 and 75 from the intermediary transfer belt 7 and a spaced state (broken line in the figure) in which the intermediary transfer belt 7 is spaced from the photosensitive drum by spacing of the primary transfer rollers 5*a*-5*c* from the intermediary transfer belt 7 and by urging of the intermediary transfer belt 7 by the spacing rollers 74 and 75 in a direction in which the intermediary transfer belt 7 is spaced from the photosensitive drums 1*a*-1*c*.

For this purpose, the contact-and-separation device 40 includes a frame 41 for supporting the primary transfer rollers 5*a*-5*c*, a rotation shaft 42 for rotatably supporting the frame 41, a cam 43 provided in contact with the frame 41, and a motor 44 for rotating the cam 43. Further, the cam 43 is rotated by the motor 44 to change a contact position between the cam 43 and the frame 41, thus rotationally moving the frame 41 about the rotation shaft 42. A direction of this rotational movement is a direction (arrow direction in the figure) in which the primary transfer rollers 5*a*-5*c* are contacted to and spaced from the intermediary transfer belt 7. The spacing rollers 74 and 75 have a mechanism in which they are moved in interrelation with movement of the frame 41 by rotation of the cam 43 similarly as in the above case.

The contact-and-separation device 40 may also have another constitution. Further, the primary transfer roller 5*d* as the first transfer member disposed opposed to the photosensitive drum 1*d* for Bk as the first photosensitive member via the intermediary transfer belt 7 is supported independently of the primary transfer rollers 5*a*-5*c* as the second transfer member.

Further, in this embodiment, the photosensitive drum 1*d* as the second photosensitive member and the photosensitive drums 1*a*-1*c* as the first photosensitive member are rotationally drivable independently of each other. For this purpose, in this embodiment, driving motors corresponding to the photosensitive drums 1*a*-1*d*, respectively, are provided, so that the photosensitive drums 1*a*-1*d* can be rotationally driven independently of each other.

In this embodiment having the above-described constitution, in the case where the operation in the monochromatic mode as the second mode is executed, the control circuit 50 places the intermediary transfer belt 7 and the photosensitive drums 1*a*-1*c* in the spaced state by the contact-and-separation device 40, and rotates the photosensitive drum 1*d* but does not rotate the photosensitive drums 1*a*-1*c*. On the other hand, in the case where the full-color mode as the first mode is executed, the control circuit 50 places the intermediary transfer belt 7 and the photosensitive drums 1*a*-1*c* in the contact state by the contact-and-separation device 40 and rotates all the photosensitive drums 1*a*-1*d*. Other constitutions are similar to those in First Embodiment.

A flow of such control in this embodiment will be described with reference to FIG. 6. When printing is started, the control circuit 50 switches control depending on a mode (monochromatic mode or full-color mode) selected by a user (S301). In the case where the mode is switched to the monochromatic mode in S301, the control circuit 50 controls the contact-and-separation device 40 to space the intermediary transfer belt 7 from the photosensitive drums 1*a*-1*c* to place the intermediary transfer belt 7 and the photosensitive drums 1*a*-1*c* in the spaced state (S302). The reason why the intermediary transfer belt 7 is spaced from the photosensitive drums 1*a*-1*c* is that when the photosensitive drums 1*a*-1*c* are stopped and the intermediary transfer belt 7 is rotated in a state where the pressure is applied at the primary transfer portions, the photosensitive drums are abraded by rubbing only at a position where the pressure is applied from the intermediary transfer belt 7.

Next, the control circuit 50 controls a motor through the motor control circuit 34 to rotate the photosensitive drum 1*d* for Bk and the intermediary transfer belt 7 at predetermined speeds, respectively (S303). At this time, other photosensitive drums 1*a*-1*c* for Y, M and C are not rotated. Then, the control circuit 50 controls the voltage source 20 to apply only a high DC voltage of, e.g., −1300 V to the charging roller 2*d* for Bk by the DC voltage source 22*a*, thus charging the surface of the photosensitive drum 1*d* to a predetermined potential (e.g., −700 V) (S304). At this time, to the charging rollers 2*a*-2*c* for Y, M and C, the AC voltage and the DC voltage are not applied. Then, image formation of a monochromatic (white/black) image is effected (S305). When the image formation is ended, the control circuit 50 turns off the application of the high DC by the DC voltage source 22*a* of the voltage source 20 and causes the motor control circuit 34 to stop the rotations of the photosensitive drum 1*d* of the intermediary transfer belt 7 (S306), thus ending the operation.

On the other hand, in the case where the mode is switched to the full-color mode in S301, the control circuit 50 controls the contact-and-separation device 40, so that the intermediary transfer belt 7 and the photosensitive drums 1*a*-1*c* are contacted to be placed in the contact state (S307). Next, the control circuit 50 controls the motor through the motor control circuit 34 to rotate all the photosensitive drums 1*a*-1*d* and the intermediary transfer belt 7 at the predetermined speeds (S308). Then, the control circuit 50 applies, to the charging rollers 2*a*-2*d* through the voltage source 20, the voltage in the form of a high DC voltage (e.g., −700 V) biased with a high AC voltage (e.g., 1.5 kV as the peak-to-peak voltage Vpp), thus charging each of the surfaces of the photosensitive drums 1*a*-1*d* to, e.g., −700 V (S309). That is, by the DC voltage sources 22*a* and 22*b* and the AC voltage source 21, the voltage in the form of the DC voltage biased with the AC voltage is applied to the charging rollers 2*a*-2*d*. Thereafter, full-color image formation is effected (S305). When the image formation is ended, the control circuit 50 turns off the application of the high AC voltage and the high DC voltage by the voltage source 20 and causes the motor control circuit 34 to stop the rotations of the photosensitive drums 1*a*-1*d* and the intermediary transfer belt 7 (S306), thus ending the operation.

In this embodiment, in the operation in the monochromatic mode, the high DC voltage for charging is applied to only the charging roller 2*d* and is not applied to the charging rollers 2*a*-2*c*, and the photosensitive drums 1*a*-1*c* for Y, M and C are not rotated. For this reason, the drum abrasion amount of other photosensitive drums 1*a*-1*c* can be more reduced. Other constitutions and functions are similar to those in First Embodiment described above.

<Other Embodiment>

In the above-described embodiments, the four-color based image forming apparatus is described but the present invention is also applicable to an image forming apparatus including image forming portions of a plurality of colors other than the four colors. Further, the contact-and-separation device 40 is not limited to that described in Second Embodiment but may also be configured to move the photosensitive drums 1*a*-1*c* and may also employ a constitution in which the spacing rollers 74 and 75 are not provided and the driving roller 71 is moved in interrelation with movement of the primary transfer rollers 5*a*-5*c* thereby to space the intermediary transfer belt 7 from the photosensitive drums 1*a*-1*c*. Further, in the above-described embodiments, an example in which the drum cleaning device includes the cleaning blade is described, but the cleaning member is not limited to the cleaning blade but may also be a member for cleaning the photosensitive drum surface by rubbing. Further, in the above-described embodiments, the intermediary transfer type in which the toner image formed on the photosensitive drum is transferred onto the recording material via the intermediary transfer belt is described but the present invention is applicable to also a direct transfer type in which the toner image is directly transferred from the photosensitive drum onto the recording material. Further, the first mode and the second mode are not limited to the full-color mode and the monochromatic mode but may also be appropriately settable. For example, in the operation in the second mode, a single-color image of a color other than black may also be formed or an image of two colors may also be formed. Further, in the operation in the first mode, an image of two colors, three colors or five or more colors may also be formed. In summary, the present invention is applicable when the number of the photosensitive drums used for image formation is different between the operations in the first and second modes and is smaller in the operation in the second mode than in the operation in the first mode.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 030558/2012 filed Feb. 15, 2012, which is hereby incorporated by reference.

What is claimed is:

1. An image forming apparatus comprising:

a first image forming portion, including a first photosensitive member and a first charger for electrically charging the first photosensitive member, for forming an image on a recording material by using the first photosensitive member and the first charger;

a second image forming portion, including a second photosensitive member and a second charger for electrically charging the second photosensitive member, for forming an image on the recording material by using the second photosensitive member and the second charger;

an executing portion for selectively executing an operation in one of a plurality of modes including a first mode in which the image is formed on the recording material by using said first and second image forming portions and including a second mode in which the image is formed on the recording material by using the second image forming portion without using the first image forming portion;

an AC voltage source for applying an AC voltage to both the first charger and the second charger in common;

a first DC voltage source for applying a DC voltage to the first charger;

a second DC voltage source for applying a DC voltage to the second charger; and a controller for controlling said first DC voltage source, said second DC voltage source and said AC voltage source so that:

when the operation in the first mode is executed, application of the AC voltage by said AC voltage source and application of the DC voltages by said first and second DC voltage sources are performed, and when the operation in the second mode is executed, application of the DC voltage by said second DC voltage source is performed, and application of the AC voltage by said AC voltage source and application of the DC voltage by said first DC voltage source are stopped.

2. An image forming apparatus according to claim 1, further comprising:

a cleaning member for rubbing and cleaning a surface of the first photosensitive member;

first and second transfer members for transferring toner images formed on surfaces of the first and second photosensitive members onto an intermediary transfer member, respectively; and a spacing mechanism for spacing the first photosensitive member and the intermediary transfer member, wherein said controller effects, when the operation in the second mode is executed, control in which rotation of the first photosensitive member is stopped and the first photosensitive member and the intermediary transfer member are spaced.

3. An image forming apparatus according to claim 1, wherein the first and second chargers electrically charge the first and second photosensitive members, respectively, in contact with surfaces of the first and second photosensitive members, respectively.

* * * * *